US008444537B1

(12) United States Patent
Santoro

(10) Patent No.: US 8,444,537 B1
(45) Date of Patent: May 21, 2013

(54) CABLE AND PULLEY WEIGHTLIFTING SYSTEM APPARATUS

(76) Inventor: John G. Santoro, Rome, NY (US)

( * ) Notice: Subject to any disclaimer, the term of this patent is extended or adjusted under 35 U.S.C. 154(b) by 237 days.

(21) Appl. No.: 12/927,228

(22) Filed: Nov. 10, 2010

(51) Int. Cl.
*A63B 21/078* (2006.01)

(52) U.S. Cl.
USPC ..... 482/104; 482/92; 482/93

(58) Field of Classification Search
USPC ..... 482/45, 93, 94, 98, 99, 101, 104, 482/106, 135, 138; 248/127; D21/673, 675, D21/680, 681, 686, 691
See application file for complete search history.

(56) References Cited

U.S. PATENT DOCUMENTS

| | | | | | |
|---|---|---|---|---|---|
| 4,153,244 | A | | 5/1979 | Tauber, Jr. | |
| 4,252,314 | A | | 2/1981 | Ceppo | |
| 4,256,301 | A | | 3/1981 | Goyette | |
| 4,324,398 | A | * | 4/1982 | Hole | 482/104 |
| 4,420,154 | A | | 12/1983 | Ramsey et al. | |
| 4,441,706 | A | | 4/1984 | Korzaniewski | |
| 4,561,651 | A | * | 12/1985 | Hole | 482/104 |
| 4,700,944 | A | | 10/1987 | Sterba et al. | |
| 4,826,155 | A | | 5/1989 | James | |
| 4,934,693 | A | * | 6/1990 | Santoro | 482/98 |
| 4,973,050 | A | * | 11/1990 | Santoro et al. | 482/102 |
| 4,998,723 | A | * | 3/1991 | Santoro | 482/104 |
| 5,273,506 | A | * | 12/1993 | Dawson, Jr. | 482/104 |
| D345,999 | S | * | 4/1994 | Adkins | D21/675 |
| 5,407,403 | A | * | 4/1995 | Coleman | 482/6 |
| 6,379,287 | B1 | * | 4/2002 | Slawinski et al. | 482/104 |
| 6,537,182 | B2 | * | 3/2003 | Slawinski et al. | 482/104 |
| 6,926,649 | B2 | * | 8/2005 | Slawinski | 482/104 |
| 7,094,185 | B2 | | 8/2006 | Greenland | |
| 7,163,488 | B2 | * | 1/2007 | Anders et al. | 482/4 |
| 7,549,950 | B1 | | 6/2009 | Lundquist | |
| 7,585,259 | B2 | | 9/2009 | Turner | |
| 7,731,631 | B2 | | 6/2010 | Collias | |

* cited by examiner

*Primary Examiner* — Glenn Richman

(57) ABSTRACT

A cable and pulley weightlifting apparatus for preventing injury to a weightlifter that includes a pair of bases, a pair of vertical tubular posts, a pair of upper support brackets, a pair of cables, a pair of counterweights, and safety detent pins. Each vertical tubular post has an upper support bracket attached at the upper end and the lower end is attached to the respective pair of bases. Each cable with a counterweight attached to one end is inserted into the channels of the respective vertical tubular posts. The other cable ends with snap hook connectors attached are inserted into the upper support brackets and connected to a dumbbell cable harness or a barbell. The vertical tubular posts include apertures to receive safety detent pins for the weightbearing bar to be suspended at any desired elevation and providing safety to the user not available with other free weight systems.

9 Claims, 8 Drawing Sheets

CABLE AND PULLEY WEIGHTLIFTING SYSTEM APPARATUS

CROSS-REFERENCE TO RELATED APPLICATIONS

Not Applicable

FEDERALLY SPONSORED RESEARCH

Not Applicable

SEQUENCE LISTING OR PROGRAM

Not Applicable

BACKGROUND OF THE INVENTION

1. Field of the Invention

This invention relates to weight lifting devices. In particular, this invention provides for a cable and pulley weightlifting system which utilizes cables and pulleys for the performance of various dumbbell bar and barbell bar free weight exercises with complete safety. The invention allows dumbbell bars or barbell bar used in any exercise to be suspended at a pre-selected height for the performance of any exercise. The dumbbell bars or barbell bar remain suspended at this pre-selected height after completion of an exercise, therefore allowing the exerciser to again repeat the exercise at the pre-selected height.

2. Prior Art

Exercising apparatus and equipment have been developed that allow various free weight lifting exercises. In the prior art, various weight lifting equipment have been disclosed, including those in the following U.S. Pat. Nos.

U.S. Pat. No. 4,153,244 to Tauber Jr. Carl F. disclosed a gymnasium type equipment consisting of a weight bar attached to a pair of slides that are supported on vertical posts for performing vertical lifting exercises of the weight bar. Strap pins are used to limit the downward movement of the weight on the vertical slide posts.

U.S. Pat. No. 4,252,314 to Ceppo, Louis a weightlifting device is disclosed including two upright members, a fixed weight carrying bar coupled to cylindrical members, in a frame having several uprights. The cylindrical members and upright members guide the weightlifting bar in a fixed vertical movement.

U.S. Pat. No. 4,256,301 to Goyette, Richard G. a weightlifting apparatus is disclosed comprised of a pair of laterally spaced upright posts for supporting a weighted bar, a slidable foot member, a bench to which the slidable member is attached, safety clamps and a wheeled pulley device. The weighted bar is connected by a strand to the foot member which allows a portion of the weight to be relieved by pushing on the foot member.

U.S. Pat. No. 4,420,154 to Ramsey et al. is disclosed a weightlifting apparatus which includes a framework having a base, vertical support members which have a plurality of apertures, stop pins and an adjustment body within the slots of the vertical support members. A weightlifting bar is inserted between the slots of the vertical upright members. The adjustment means is set at a selected height to prevent injury to the weight lifter.

U.S. Pat. No. 4,441,706 to Korzaniewski, a weightlifting exercising device is disclosed including a vertically disposed framework defined by a pair of parallel, vertical, channel-shaped side members interconnected at the top and bottom by square tubing. A weightlifting bar is contained within the upright channel members and receiving pins inserted in the apertures of vertical uprights at a pre-determined point so the bar can not be moved below this height to protect the exerciser.

U.S. Pat. No. 4,561,651 to Hole is disclosed a weightlifting machine which includes a weight arresting bar, a detachable weight pulling assembly, a pair of upright members, pair of base members, adjustment mechanism with manually adjustable latches at each end of a stop bar to engage passages formed in the upright frame members. The stop bar limits the downward movement of the weights in order to prevent injury to the exerciser.

U.S. Pat. No. 4,700,944 to Sterba, Richard F., et al. is disclosed an exercise equipment which has upright guide tracks, a detachable bar carriage, detachable weight carriage, a pulley apparatus, a rotating bar apparatus and safety catch. The weight carriage is suspended within the upright guide tracks and can be positioned at a predetermined height. The weightlifting bar contained within the bar carriage is moved in a fixed path within the slots of the upright guide tracks.

U.S. Pat. No. 4,826,155 to James, Laurence H. a weightlifting harness apparatus secured about the chest of an exerciser. The harness structure is connected to a cable which extends over a pulley-block unit that allows an attendant to assist the exerciser during the performance of an exercise.

U.S. Pat. No. 7,094,185 to Greenland, Darrell a versatile exercise machine that uses a free weight holder sliding along a rail, and adjacent free weight support to determine the lowermost travel of the free weight. Uses a handle system to incorporate free weights coupled to the handle by a line or cable.

U.S. Pat. No. 7,549,950 to Lundquist, Randal L, a weight bar slide assembly, for use with weightlifting equipment having vertical guide bars that provide for an accurate simulation of the free weight lifting motion. The weight bar slide assembly has a weight bar sleeve to rotatably receive a weight bar. A rod is attached to the weight bar sleeve and extends outwardly therefrom. A rod sleeve rotatably receives the rod. The rod may rotate along its longitudinal axis inside the rod sleeve. The rod sleeve is attached to a vertical guide. The vertical guide is movably mounted to a vertical guide bar. The longitudinal axis rotation of the rod within the rod sleeve allows for the freedom of motion found in the free weight lifting motion. The weight bar slide assemblies attached to opposing ends of the weight bar may move linearly along the vertical guide bar independently of each other.

U.S. Pat. No. 7,585,259 to Turner, Joseph Scott, a weightlifting apparatus that supports a free weight barbell when activated using two counter-weight controlled support arms that are mechanically attached to a vertical support on a bench press system. The vertical supports each have a slide rail that is mechanically coupled to a locking assembly that acts to release the support arms using buttons. The support arms are attached to independent counterweights or springs by means of a cable. When released by a foot pedal these support arms are elevated by the counterweights. The support arms hold the barbell and prevent it from downward movement via the one-way locking assembly mounted to the support arms. The support arms work independently of one another so that a user may reset each support arm independently.

U.S. Pat. No. 7,731,631 to Collias, Constantine Dean Paul a weightlifting apparatus includes a pair of spaced-apart support columns which carry a pair of spaced-apart self-spotter bars. The self-spotter bars extend from the columns such that the height and optionally the angle can be adjusted. The self-spotter bars are positioned to hold a weight bar at a safe height should the user drop the weight during an exercise.

None of the above weightlifting systems provide a capability for using cables and pulleys that allow either dumbbell bars or barbell bar exercises that have the dumbbell bars or a barbell bar suspended at a pre-selected height for the performance of free weight exercises. The dumbbell bars or a barbell bar remain suspended at this pre-selected height after the completion of an exercise therefore allowing the exerciser to again repeat the exercise at the pre-selected height. This weightlifting apparatus provides the means to perform various free weight exercises with the versatility and safety advantages that are not available with any of the above weightlifting systems.

SUMMARY OF THE INVENTION

A principal object of the invention is to provide a free weightlifting apparatus which combines the features of a free weight apparatus and a safety constrained apparatus but which makes available new advantages in weight lifting over both types of apparatus taken separately.

Another object of the invention is to employ a cable and pulley system with counter weights, snap hook connectors, and safety detent pins for controlling the movement of dumbbell bars or a barbell bar in various exercises and without the need for any assistance.

Another object of this invention is to provide a means for suspending dumbbell bars or a barbell bar at a pre-selected height for any exercise and after the exercise is completed the dumbbell bars or a barbell bar remain suspended at the pre-selected height so that the exerciser may again repeat the exercise without having to retrieve and reposition the dumbbell bars or the barbell bar at the desired starting position.

A still further object of this invention is to provide a safety system which limits the downward movement of dumbbell bars or barbell bar at a pre-selected elevated position during any exercise.

A further object of the invention is to provide a cable and pulley system free weight apparatus for preventing injury to a weight lifter from the crashing down of dumbbell bars or a barbell bar during the performance of any exercise.

It is a further object of this invention to allow unrestricted vertical and horizontal movement of the dumbbell bars or a barbell bar during the performance of any exercise.

Another object of the invention is to allow the easy exchange of dumbbell bars with a barbell bar or vice versa without any modification to the cable support system or the weightlifting apparatus.

DRAWINGS

Figures

The above and other objects and features of the weightlifting apparatus will become more readily apparent on examination of the following detailed description including the drawings in which like reference numerals refer to like parts.

DRAWINGS

Reference Numerals

Figure 1:
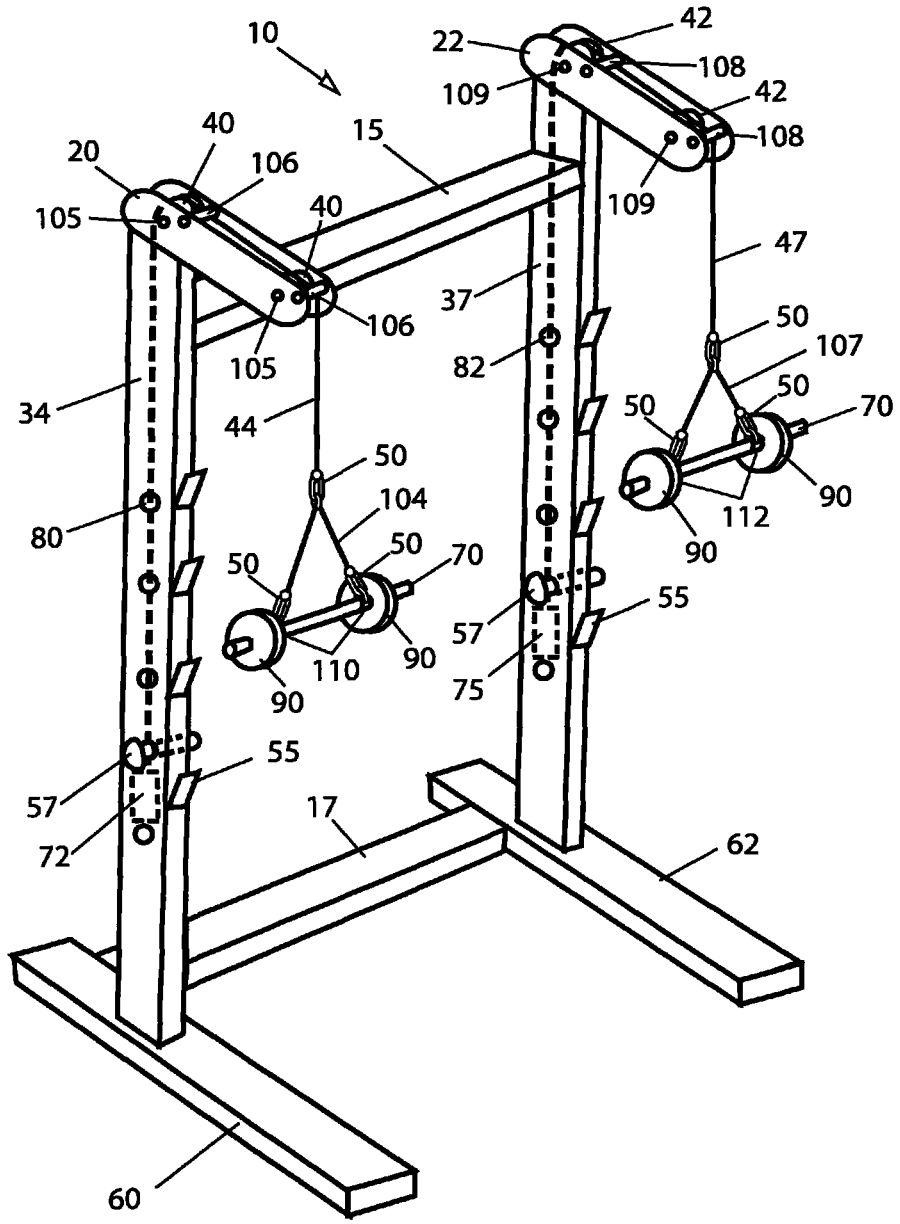
FIG. 1 is a perspective view of the weightlifting apparatus with dumbbell bars.
Figure 2:
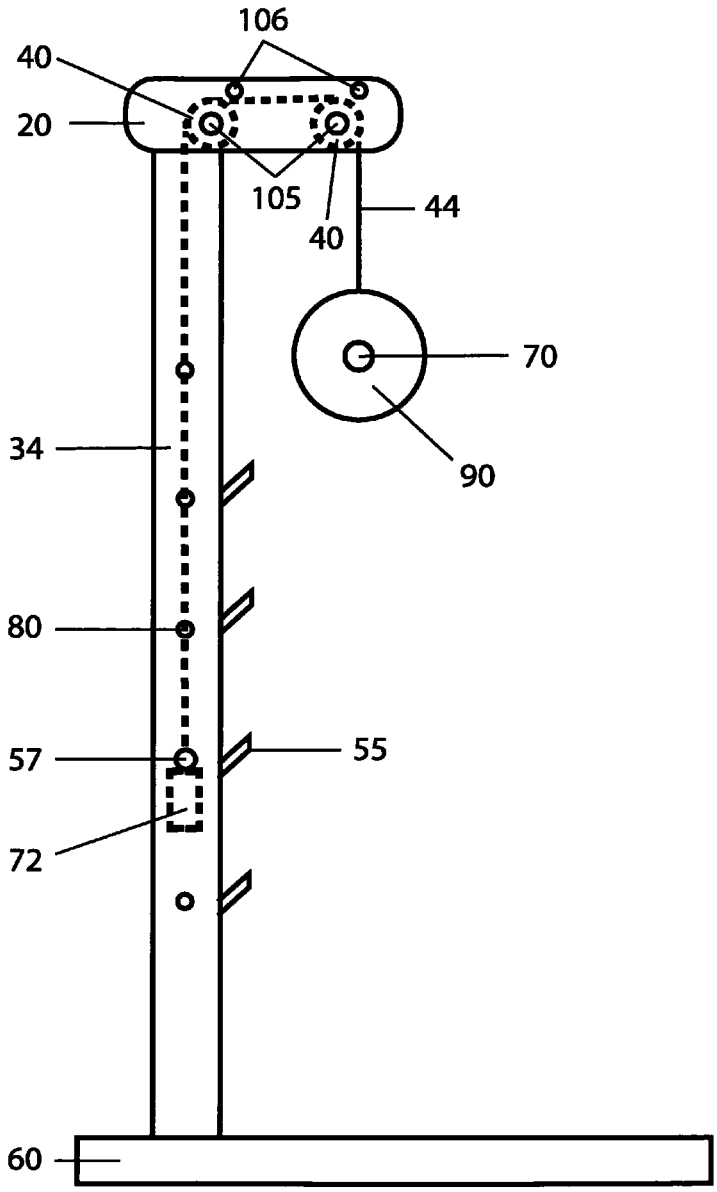
FIG. 2 is a side view of the weightlifting apparatus with a dumbbell bar and weight plates.
Figure 3:
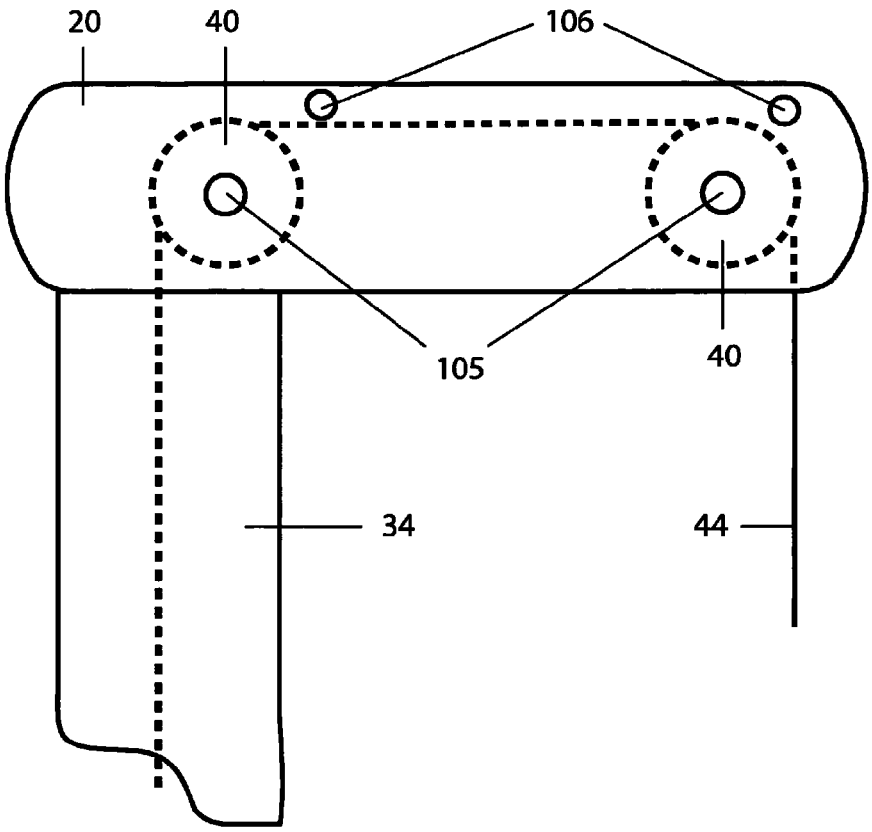
FIG. 3 is an enlarged fragmentary perspective detailed side view of an upper support bracket attached to the upper end of a vertical tubular post and is comprised of a pair of pulleys, a pair of pulley bolts, a cable and a pair of cable guides.
Figure 4:
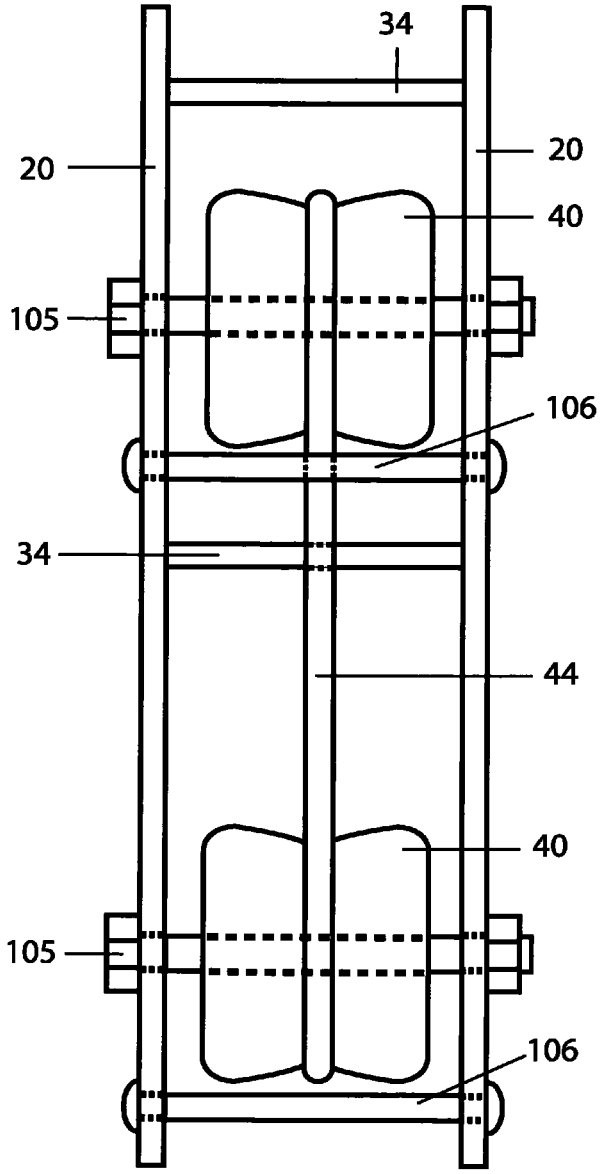
FIG. 4 is a top view of an upper support bracket attached to the upper end of a vertical tubular post and is comprised of a pair of pulleys, a pair of pulley bolts, a cable and a pair of cable guides.
Figure 5:
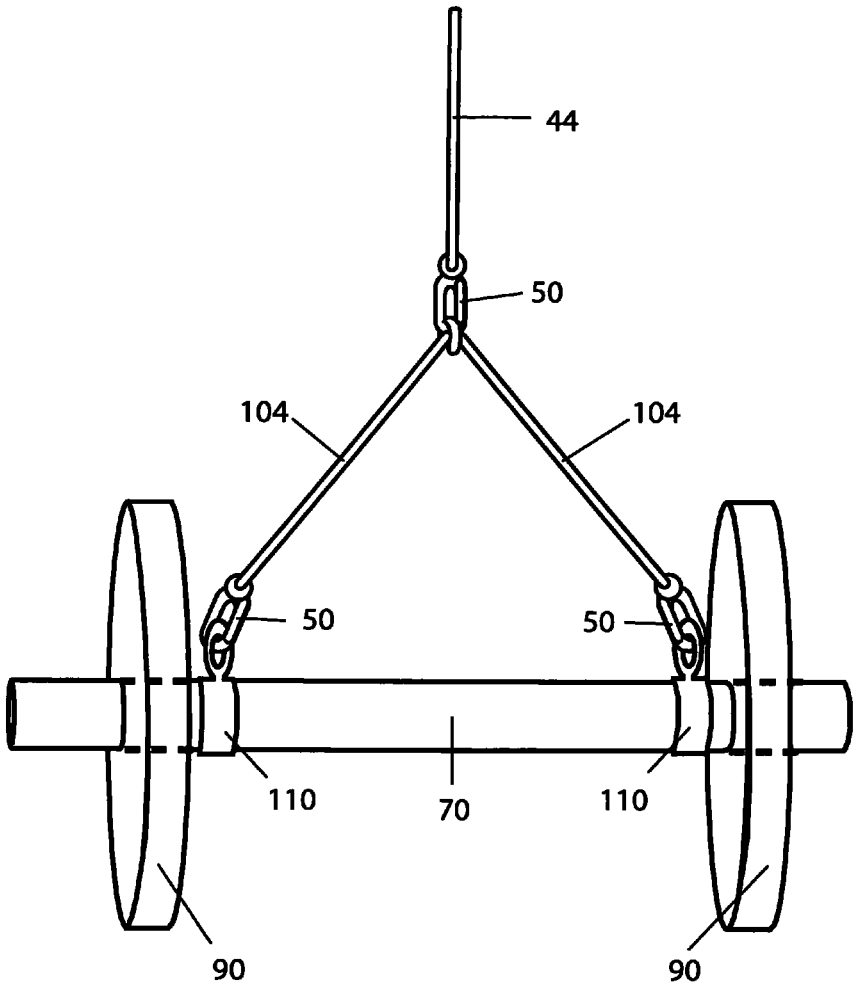
FIG. 5 is an enlarged view of a dumbbell bar and a cable harness associated therewith together with a cable, snap hook connectors, a pair of dumbbell bar connectors and weight plates.

| | |
|---|---|
| 10 | Weightlifting Apparatus |
| 15 | Upper Transverse Member |
| 17 | Lower Transverse Member |
| 20 | First Upper Support Bracket |
| 22 | Second Upper Support Bracket |
| 34 | First vertical Tubular Post |
| 37 | Second vertical Tubular Post |
| 40 | First Pulley System |
| 42 | Second Pulley System |
| 44 | First Cable |
| 47 | Second Cable |
| 50 | Snap Hook Connectors |
| 52 | Barbell Connectors |
| 55 | Series of vertically aligned Hook Brackets |
| 57 | Safety Detent Pins |
| 60 | First Lower Base |
| 62 | Second Lower Base |
| 70 | Dumbbell Bars |
| 72 | First Counter Weight |
| 75 | Second Counter Weight |
| 80 | First series of vertically aligned Apertures |
| 82 | Second series of vertically aligned Apertures |
| 84 | Barbell Bar |
| 90 | Weight Plates |
| 104 | First Dumbbell Cable Harness |
| 105 | First pair Pulley Bolts |
| 106 | First pair Cable guides |
| 107 | Second Dumbbell Cable Harness |
| 108 | Second pair Cable guides |
| 109 | Second pair Pulley Bolts |
| 110 | Dumbbell Connectors |
| 112 | Dumbbell Connectors |

DETAILED DESCRIPTION OF THE PREFERRED EMBODIMENT

The present invention relates generally to an improved, weightlifting exercise device, where-in the improvements contribute to performing a variety of free weight lifting exercises with weighted dumbbell bars or a weighted barbell bar and for preventing injury to a weightlifter in the event of physical exhaustion and when an exercise cannot be physically completed. The operational mode of this invention permits the exerciser to perform a last forced repetition without any danger of the exercising weight crashing down on the exerciser without any assistance from a "spotter". Referring in detail now to the drawings, wherein like reference numerals designate similar parts throughout the various views, there is seen a cable and pulley free weight exercising apparatus of the present invention as designated by reference numeral 10.

Figure 6:
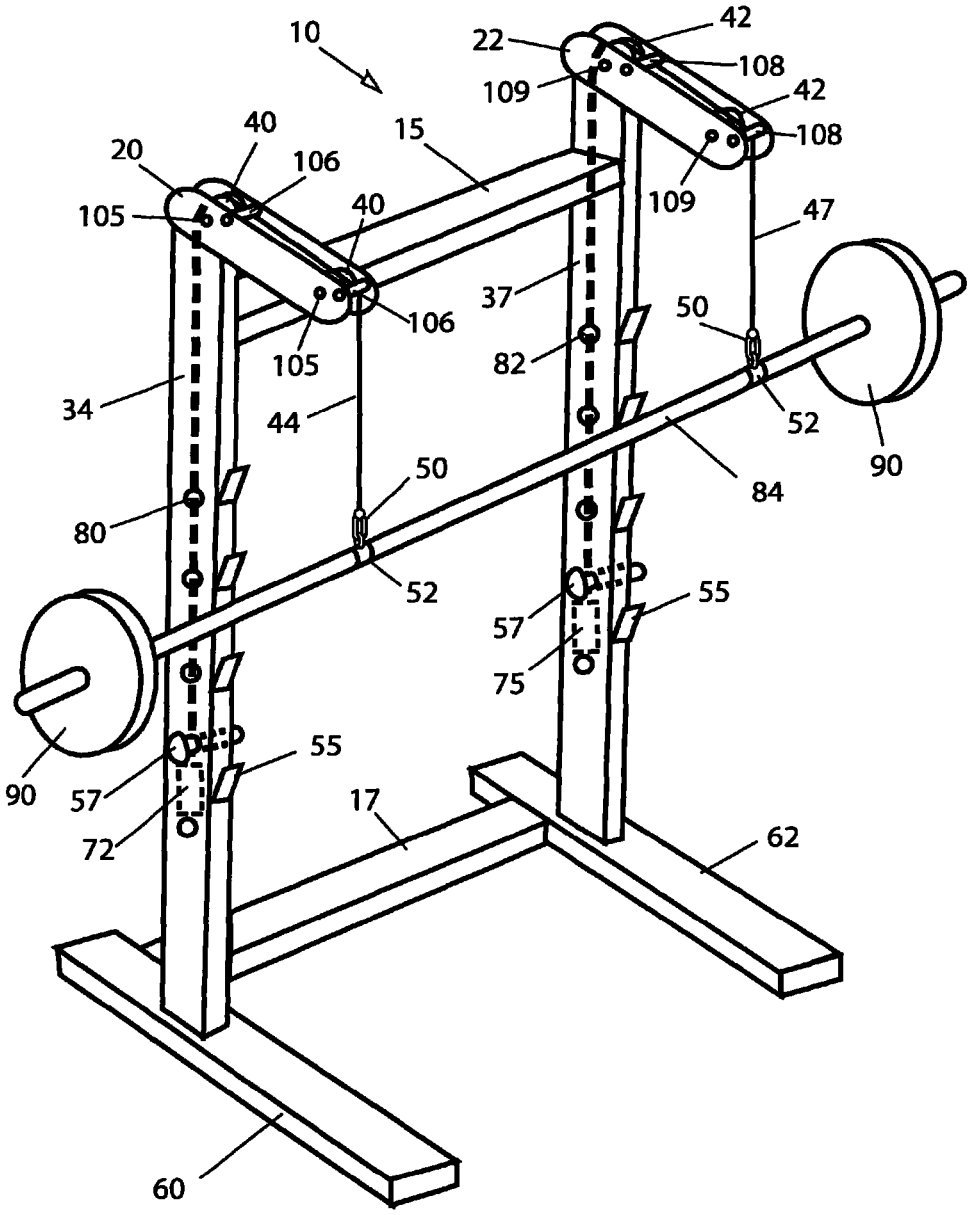
FIG. 6 is a perspective view of the weightlifting apparatus with a barbell bar.
Figure 7:
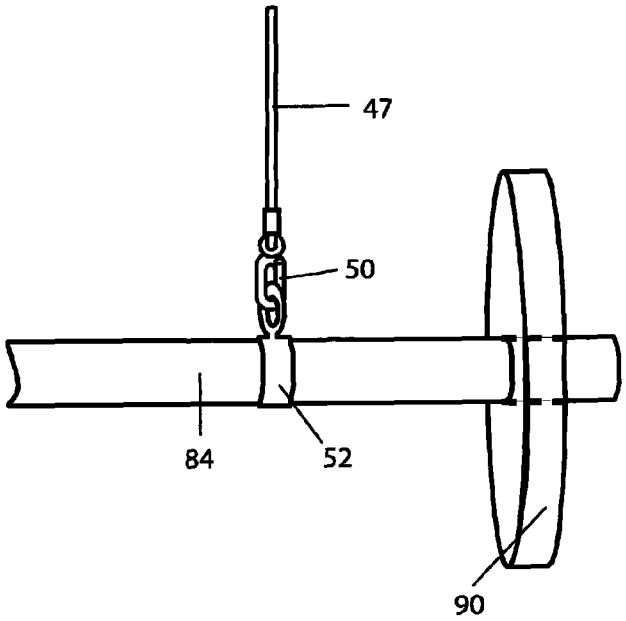
FIG. 7 is an enlarged fragmentary view of a barbell bar with a cable, snap hook connector, a barbell bar connector, and weight plates.
Figure 8:
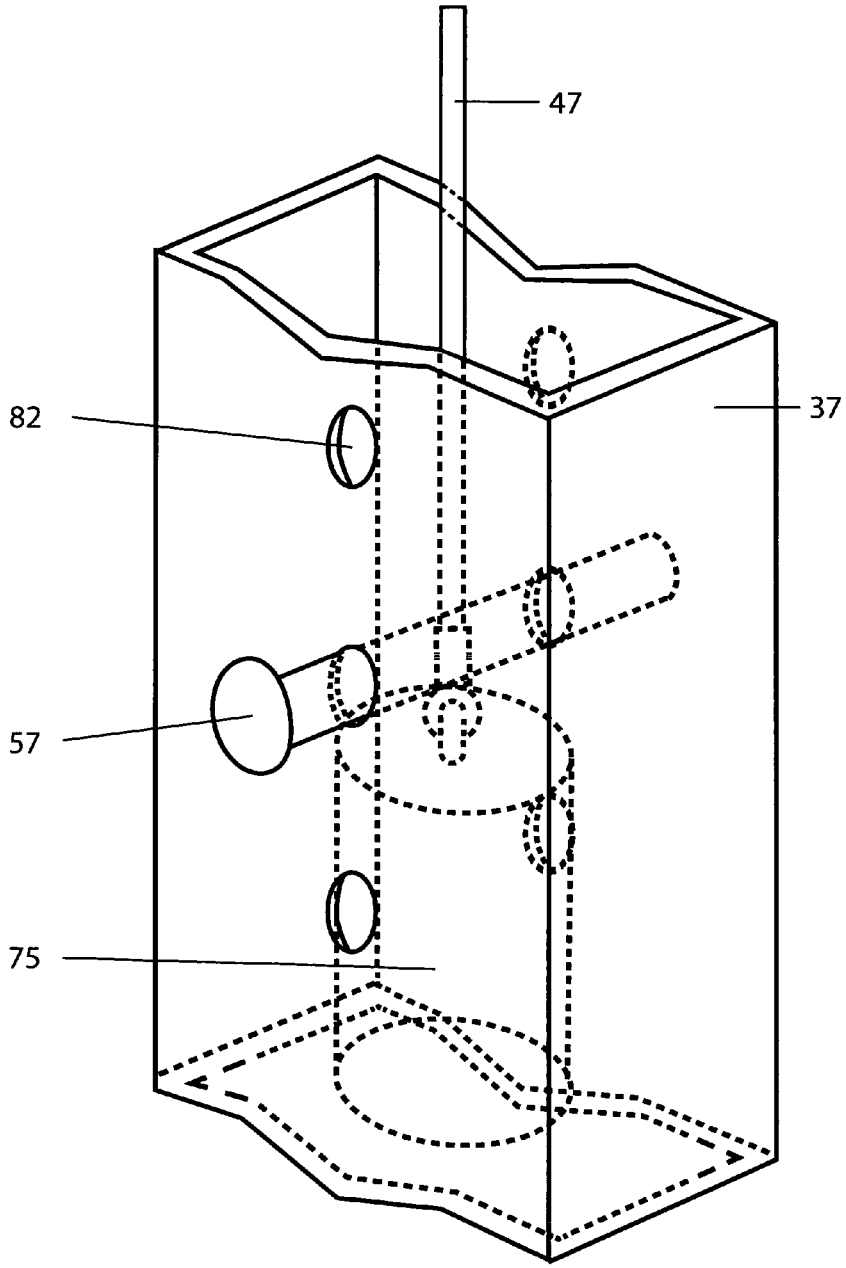
FIG. 8 is an enlarged, fragmentary view of a vertical tubular post with a cable attached to a counter weight, and a safety detent pin contained in an aperture within a vertical tubular post.

The weightlifting apparatus 10 as shown in FIG. 1 and FIG. 6 has a pair of lower bases 60 and 62, a pair of vertical tubular posts 34 and 37 containing a series of vertically aligned apertures 80 and 82 and having a pair of upper support brackets 20 and 22, a pair of counter weights 72 and 75, an upper transverse member 15, a lower transverse member 17, a pair of cables 44 and 47, a pair of pulley systems 40 and 42, a pair of cable guides 106 and 108, a pair of pulley bolts 105 and 109, a pair of cable harnesses 104 and 107, snap hook connectors 50, a pair of dumbbell bars 70, a pair of dumbbell connectors 110 and 112, a barbell bar 84, a pair of barbell connectors 52, weight plates 90, a series of vertically aligned hook brackets 55 welded to each of the vertical tubular posts 34 and 37 and a pair of safety detent pins 57 for insertion into vertically aligned apertures 80 and 82 of vertical tubular posts 34 and 37. The lower end of the vertical tubular post 34 is attached to the top of the lower base 60 and the lower end of the vertical tubular post 37 is attached to the top of the lower base 62.

As shown in FIG. 1 and FIG. 6 the lower transverse bar 17 is interconnected to the spaced lower bases 60 and base 62. The upper transverse bar 15 is interconnected at the upper end of the spaced vertical tubular posts 34 and 37.

As shown in FIG. 1 and FIG. 6 the spaced vertical tubular posts 34 and 37 have a uniform series of vertically coaxial aligned apertures 80 and 82 respectively, transversely through the vertical tubular posts 34 and 37 and the series of vertically aligned apertures 80 in vertical tubular post 34 being in coaxial alignment with the series of vertically aligned apertures 82 in vertical tubular post 37.

One end of each of the cables 44 and 47 are connected to the counter weights 72 and 75 respectively, and the opposite ends of the cables 44 and 47 are then attached to snap hook connectors 50. The counter weight 72 attached to one end of cable 44 is inserted into the channel of the upper end of the vertical tubular post 34 and the other counter weight 75 attached to one end of cable 47 is inserted into the channel of the upper end of the vertical tubular post 37.

The snap hook connector 50 attached to the other end of cable 44 is inserted into the first upper support bracket 20 attached to the vertical tubular post 34. The snap hook connector 50 is placed under the pair of first cable guides 106 and then placed over the pair of pulleys in the first pulley system 40.

The snap hook connector 50 that is attached to the other end of cable 47 is inserted into the second upper support bracket 22 attached to the vertical tubular post 37. The snap hook connector 50 is placed under the pair of second cable guides 108 and then placed over the pair of pulleys in the second pulley system 42.

It should be noted that the starting height for an exercise with dumbbell bars 70 or barbell bar 84 is selected by the exerciser with the insertion of safety detent pins 57 into the apertures 80 and 82 respectively, at the pre-selected height. The safety detent pins 57 inserted into the pre-selected coaxially vertically aligned apertures 80 and 82 of the vertical tubular posts 34 and 37 respectively, limit the upward movement of the counter weights 72 and 75 within the vertical tubular posts 34 and 37 respectively. The opposite ends of cables 44 and 47 with snap hook connectors 50 that are in upper support brackets 20 and 22 respectively, are then limited in their downward movement to the original selected starting height.

If the weight lifter desires to perform weighted dumbbell bars 70 exercises the weight lifter sets up the apparatus 10 as shown in FIG. 1 by selecting a starting height at which they feel most comfortable to begin a selected exercise by employing the following procedure.

The ends of the cables 44 and 47 with snap hook connectors 50 are lowered to the desired starting height for an exercise and the weight lifter selects the height at which the counter weights 72 and 75 are to be arrested. The exerciser then inserts the safety detent pins 57 into the apertures 80 and 82 of the vertical tubular posts 34 and 37 respectively, to arrest the counter weights 72 and 75 at the desired starting height. This will also maintain the snap hook connectors 50 at the ends of cables 44 and 47 at the selected starting height. The snap hook connectors 50 at the ends of cables 44 and 47 are then connected to the upper ends of the cable harnesses 104 and 107 respectively. The lower ends of cable harnesses 104 and 107 with snap hook connectors 50 are then attached to the dumbbell bar connectors 110 and 112 respectively. This will suspend the weighted dumbbell bars 70 at the original selected exercise starting position and allow the weight lifter to perform repetitions or sets of an exercise with complete safety.

During the performance of an exercise the weight lifter has the freedom of resting between repetitions or sets of an exercise and can also repeat a repetition or another set of the same exercise without having to place the weighted dumbbell bars 70 on the floor since the weighted dumbbell bars 70 will remain suspended at the original starting height selected for the exercise.

The invention allows the counter weights 72 and 75 to move freely in an ascending and descending movement within the vertical tubular posts 34 and 37 respectively, up to the pre-selected height. When the exerciser moves the weighted dumbbell bars 70 in an upward direction from the selected exercise starting position the counter weights 72 and 75 descend freely within the channel of the vertical tubular posts 34 and 37 respectively. The pair of pulley systems 40 and 42 contained within the upper support brackets 20 and 22 respectively, allow the dumbbell bars 70 to move freely in a vertical or horizontal direction.

If the weight lifter chooses to perform weighted barbell bar 84 exercises the weightlifter sets up the apparatus 10 as shown in FIG. 6 by selecting a starting height at which they feel most comfortable to begin the selected exercise by employing the following procedure. They place the barbell bar 84 at the selected height on the hook brackets 55 attached to the vertical tubular posts 34 and 37 respectively. The hook brackets 55 maintain the weighted barbell bar 84 at this starting height and allow the adding or exchanging of weight plates 90 without the weighted barbell bar 84 tipping over when one end has a greater amount of weight.

The ends of cables 44 and 47 with the snap hook connectors 50 are lowered to the desired starting height for an exercise and the weight lifter selects the height at which the counter weights 72 and 75 are to be arrested. The exerciser then inserts the safety detent pins 57 into apertures 80 and 82 of the vertical tubular posts 34 and 37 respectively, to arrest the counter weights 72 and 75 at the desired starting height. This will also maintain the snap hook connectors 50 at the ends of cables 44 and 47 at the selected starting height. The snap hook connectors 50 at the ends of the cables 44 and 47 are then connected to the barbell bar connectors 52 respectively. This will suspend the weighted barbell bar 84 at the original selected exercise starting position and allow the weight lifter to perform repetitions or sets of an exercise with complete safety.

During the performance of an exercise the weight lifter has the freedom of resting between repetitions or sets of an exercise and can also repeat a repetition or another set of the same exercise without having to place the weighted barbell bar 84 on the floor since the weighted barbell bar 84 will remain suspended at the original starting height selected for the exercise.

The invention allows the counter weights 72 and 75 to move freely in an ascending and descending movement within the vertical tubular posts 34 and 37 respectively, up to the pre-selected height. When the exerciser moves the weighted barbell bar 84 in an upward direction from the selected exercise starting position the counter weights 72 and 75 descend freely within the channel of the vertical tubular posts 34 and 37 respectively. The pair of pulley systems 40 and 42 contained within the upper support brackets 20 and 22 respectively, allow the weighted barbell bar 84 to move freely in a vertical or horizontal direction.

Other known weight lifting apparatus which use pulleys with cables do not provide means for performing exercises with weighted dumbbell bars and weighted barbell or allow the weighted dumbbell bars or weighted barbell to be suspended at a pre-selected exercise height or prevent the weighted dumbbell bars or weighted barbell from crashing down on the exerciser when a repetition can not be completed.

The prior art weight lifting apparatus use pulleys with cables to perform only weighted barbell exercises and are restricted in their horizontal movement. The operational modes of the within inventive device are a noteworthy contribution to prior art devices, it is to be noted that an exerciser can safely perform exercises with the weighted dumbbell bars 70 or the weighted barbell bar 84, have unlimited horizontal and vertical movement of the weighted dumbbell bars 70 or the weighted barbell bar 84, perform forced repetitions or multiple sets in total safety and without the need of a "spotter" since the weighted dumbbell bars 70 or the weighted barbell bar 84 will remain suspended at the pre-selected starting exercise height whenever the exerciser releases the weighted dumbbell bars 70 or the weighted barbell bar 84.

From the foregoing descriptions it should be readily appreciated as shown in FIG. 1, FIG. 2, FIG. 3, FIG. 4, FIG. 5, FIG. 6, FIG. 7, and FIG. 8 the inventive device 10 is adapted both by its construction and operational mode, to permit various embodiments and a wide range of weightlifting exercises.

This invention is not to be construed as limited to the particular forms, size and materials disclosed herein since they are to be regarded as illustrative rather than restrictive. It will be clear to those skilled in the art that various alterations, modifications, rearrangements and permutations of the materials and parts may be made without departing from the spirit and scope of the underlying inventive concept. A latitude of modifications, changes, and substitutions are intended in the foregoing disclosure and in some instances some features of the invention will be employed without a corresponding use of other features. Accordingly it is appropriate that the appended claims be interpreted as including such alterations, modifications, permutations and rearrangements as fall within the true spirit and scope of the invention herein.

What is claimed and desired to be protected by United States Patent is:

1. A cable and pulley weightlifting apparatus for preventing injury to a weightlifter comprising:

a framework including a pair of laterally spaced base sections, a spaced vertical upright comprising a vertical tubular post extending vertically upwardly from each said base section, said vertical tubular post having a plurality of vertically aligned apertures extending therethrough at regular intervals, said vertical tubular post having an attached upper support bracket, an upper transverse member mounted to and extending between the upper ends of said vertical tubular posts, and a lower transverse member mounted to and extending between the laterally spaced said base sections;

a first and second said upper support bracket attached to the upper end of each said vertical tubular post;

a first and second pulley system, one said pulley system being contained within each said upper support bracket;

a first and second counterweight, one said counterweight being slidably inserted within each said vertical tubular post;

a first and second dumbbell cable harness;

a first and second dumbbell bar;

a first and second cable, said first cable having a first end connected to said first counter weight and said first counter weight being inserted into the open end of said first vertical tubular post and having a second end inserted into said first upper support bracket and then connected to the upper end of said first dumbbell cable harness and the lower ends of said first dumbbell cable harness connected to said first dumbbell bar, said second cable having a first end connected to said second counter weight and said second counter weight being inserted into the open end of said second vertical tubular post and having a second end inserted into said second upper support bracket and then connected to upper end of said second dumbbell cable harness and the lower ends of said second dumbbell cable harness connected to said second dumbbell bar;

a pair of safety detent pins, one said safety detent pin being removably insertable into said vertically aligned apertures of each said vertical tubular post, said safety detent pin extending through said vertical tubular posts and defining the upper limit of travel of said counter weight within said vertical tubular posts;

whereby said safety detent pins are inserted into said vertically aligned aperture of said vertical tubular posts at a predetermined height selected to perform an exercise such that said safety detent pins will limit the upward travel of said counter weight to prevent the downward travel of said first and said second dumbbell bars below the height selected for the start of an exercise.

2. The weightlifting apparatus as recited in claim 1 wherein the second end of each said cable is connected to the upper end of each said dumbbell cable harness and the lower ends of each said dumbbell cable harness is connected to each said dumbbell bar such that said dumbbell bars are suspended in a balanced horizontal position.

3. The weightlifting apparatus as recited in claim 1 wherein the second end of each said cable is removably connected to the upper end of each said dumbbell cable harness.

4. The weightlifting apparatus as recited in claim 1 wherein the lower ends of each said dumbbell cable harness are removably connected to each said dumbbell bar.

5. The weightlifting apparatus as recited in claim 1 wherein each said dumbbell bar includes ends to receive replaceable weight plates thereon.

6. A cable and pulley weightlifting apparatus for preventing injury to a weightlifter comprising:

a framework including a pair of laterally spaced base sections, a spaced vertical upright comprising a vertical tubular post extending vertically upwardly from each said base section, said vertical tubular post having a plurality of vertically aligned apertures extending therethrough at regular intervals, said vertical tubular post having an attached upper support bracket, an upper transverse member mounted to and extending between the upper ends of said vertical tubular posts, and a lower transverse member mounted to and extending between the laterally spaced said base sections;

a first and second said upper support bracket attached to the upper end of each said vertical tubular post;

a first and second pulley system, one said pulley system being contained within each said upper support bracket;

a first and second counterweight, one said counterweight being slidably inserted within each said vertical tubular post;

a barbell bar;

a first and second cable, said first cable having a first end connected to said first counter weight and said first counter weight being inserted into the open end of said first vertical tubular post and having a second end inserted into said first upper support bracket and then connected to said barbell bar, said second cable having a first end connected to said second counter weight and said second counter weight being inserted into the open end of said second vertical tubular post and having a second end inserted into said second upper support bracket and then connected to said barbell bar;

a pair of safety detent pins, one said safety detent pin being removably insertable into said vertically aligned apertures of each said vertical tubular post, said safety detent pin extending through said vertical tubular posts and defining the upper limit of travel of said counter weight within said vertical tubular posts;

whereby said safety detent pins are inserted into said vertically aligned aperture of said vertical tubular posts at a predetermined height selected to perform an exercise such that said safety detent pins will limit the upward travel of said counter weight to prevent the downward travel of said barbell bar below the height selected for the start of an exercise.

7. The weightlifting apparatus as recited in claim 6 wherein the second end of each said cable is connected to said barbell bar such that said barbell bar is suspended in a balanced horizontal position.

8. The weightlifting apparatus as recited in claim 6 wherein the second end of each said cable is removably connected to said barbell bar.

9. The weightlifting apparatus as recited in claim 6 wherein said barbell bar includes ends to receive replaceable weight plates thereon.

* * * * *